US010900661B2

(12) United States Patent
Cadima

(10) Patent No.: US 10,900,661 B2
(45) Date of Patent: Jan. 26, 2021

(54) BOOSTED GAS BURNER ASSEMBLY WITH PULSE ATTENUATION

(71) Applicant: Haier US Appliance Solutions, Inc., Wilmington, DE (US)

(72) Inventor: Paul Bryan Cadima, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 73 days.

(21) Appl. No.: 16/143,552

(22) Filed: Sep. 27, 2018

(65) Prior Publication Data

US 2020/0103106 A1 Apr. 2, 2020

(51) Int. Cl.

| | |
|---|---|
| ***F23N 5/18*** | (2006.01) |
| ***F23D 14/32*** | (2006.01) |
| ***F23N 1/02*** | (2006.01) |
| ***F23N 3/08*** | (2006.01) |

(52) U.S. Cl.

CPC ..... *F23D 14/32* (2013.01); *F23N 1/025* (2013.01); *F23N 3/085* (2013.01); *F23N 2005/181* (2013.01)

(58) Field of Classification Search

CPC ..... F23D 14/32
USPC ..... 431/344, 8; 126/216, 299 D
See application file for complete search history.

(56) References Cited

U.S. PATENT DOCUMENTS

| | | | | |
|---|---|---|---|---|
| 3,592,180 | A * | 7/1971 | Kweller | F23D 14/04 126/39 H |
| 5,205,727 | A * | 4/1993 | Aoki | F23C 15/00 431/1 |
| 5,213,091 | A * | 5/1993 | Beach | F24C 3/126 126/299 D |
| 6,269,808 | B1 * | 8/2001 | Murahashi | A47J 37/1242 126/391.1 |
| 8,479,721 | B2 * | 7/2013 | Graham | F23D 14/105 126/1 R |
| 2006/0078836 | A1 | 4/2006 | Kim et al. | |

FOREIGN PATENT DOCUMENTS

| | | | |
|---|---|---|---|
| CN | 107131500 | A | 9/2017 |
| DE | 10159033 | B4 | 8/2012 |
| JP | 4565203 | B2 | 10/2010 |
| KR | 20050020553 | A | 3/2005 |
| KR | 20170067933 | A | 6/2017 |

* cited by examiner

*Primary Examiner* — Avinash A Savani
(74) *Attorney, Agent, or Firm* — Dority & Manning, P.A.

(57) ABSTRACT

A gas burner assembly is provided which includes an air pump that supplies a flow of air into a boost fuel chamber for mixing with a flow of boost fuel before being combusted and directed through a plurality of boost flame ports. An accumulator is positioned between the air pump and the boost burner such that the flow of air passes though the accumulator, thereby dampening pulsations or surges from the air pump before entering the boost fuel chamber.

20 Claims, 12 Drawing Sheets

BOOSTED GAS BURNER ASSEMBLY WITH PULSE ATTENUATION

FIELD OF THE INVENTION

The present subject matter relates generally to gas burners, and more particularly to forced air gas burners for providing a constant flow of boost air.

BACKGROUND OF THE INVENTION

Conventional gas cooking appliances have one or more gas burners, e.g., positioned at a cooktop surface for use in heating or cooking an object, such as a cooking utensil and its contents. These gas burners typically combust a mixture of gaseous fuel and air to generate heat for cooking. Known burners frequently include an orifice, a Venturi mixing throat, and a plurality of flame ports. The orifice ejects a jet of gaseous fuel which entrains air while passing into the Venturi mixing throat. The air and gaseous fuel mix within the Venturi mixing throat before the mixture is combusted at the flame ports of the burners. Such burners are generally referred to as naturally aspirated gas burners.

Naturally aspirated gas burners can efficiently burn gaseous fuel. However, a power output of naturally aspirated gas burners is limited by the ability to entrain a suitable volume of air into the Venturi mixing throat with the jet of gaseous fuel. Moreover, there is a trend in the cooking appliance market toward high-powered burners in order to speed up cooking tasks. Thus, to provide increased entrainment of air, certain gas burners include a fan or air pump that supplies pressurized air for mixing with the jet of gaseous fuel. Such gas burners are generally referred to as forced air gas burners.

While offering increased power, known forced air gas burners suffer from various drawbacks. For example, known forced air gas burners use a linear piston pump or a bellows style pump which are driven by an alternating magnetic field to displace air in a cyclic manner. However, even to the extent these pumps provide suitable flow rates and pressures at acceptable noise levels, the output flow of air is often presented in a rough, pulsing manner. The pulsing is visible in the flames, adds noise to the burner flames, and easily can overexcite any pneumatic valve actuators (if used) into resonance and chattering.

Accordingly, a cooktop appliance including an improved forced air gas burner would be desirable. More specifically, a gas burner assembly that offers boost air that is consistent, stable, and quiet would be particularly beneficial.

BRIEF DESCRIPTION OF THE INVENTION

Aspects and advantages of the invention will be set forth in part in the following description, or may be apparent from the description, or may be learned through practice of the invention.

In a first example embodiment, a gas burner assembly for a cooktop appliance is provided. The gas burner assembly includes a boost burner including a plurality of boost flame ports in fluid communication with a boost fuel chamber for receiving a flow of boost fuel and an air pump for selectively urging a flow of air into the boost fuel chamber. An accumulator is positioned between and fluidly couples the air pump to the boost burner, the flow of air passing though the accumulator before entering the boost fuel chamber.

In a second example embodiment, an air pump assembly for a gas burner is provided. The gas burner includes a boost burner including a plurality of boost flame ports in fluid communication with a boost fuel chamber for receiving a flow of boost fuel. The air pump assembly includes an air pump for selectively urging a flow of air through an air pump outlet and into the boost fuel chamber and an accumulator positioned downstream of the air pump outlet between the air pump and the boost burner, the flow of air passing though the accumulator before entering the boost fuel chamber.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
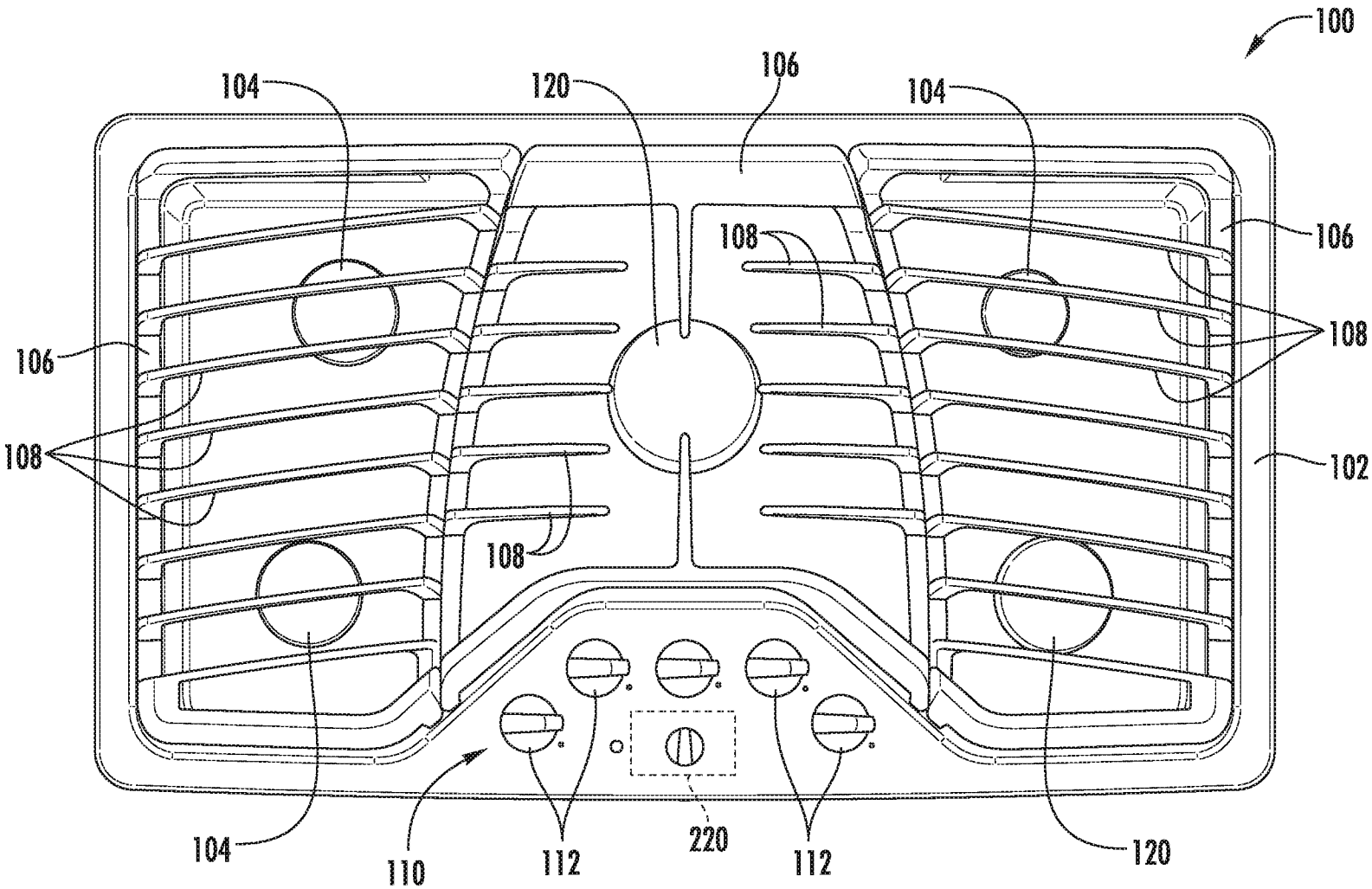
FIG. 1 provides a top, plan view of a cooktop appliance according to an example embodiment of the present disclosure.
Figure 2:
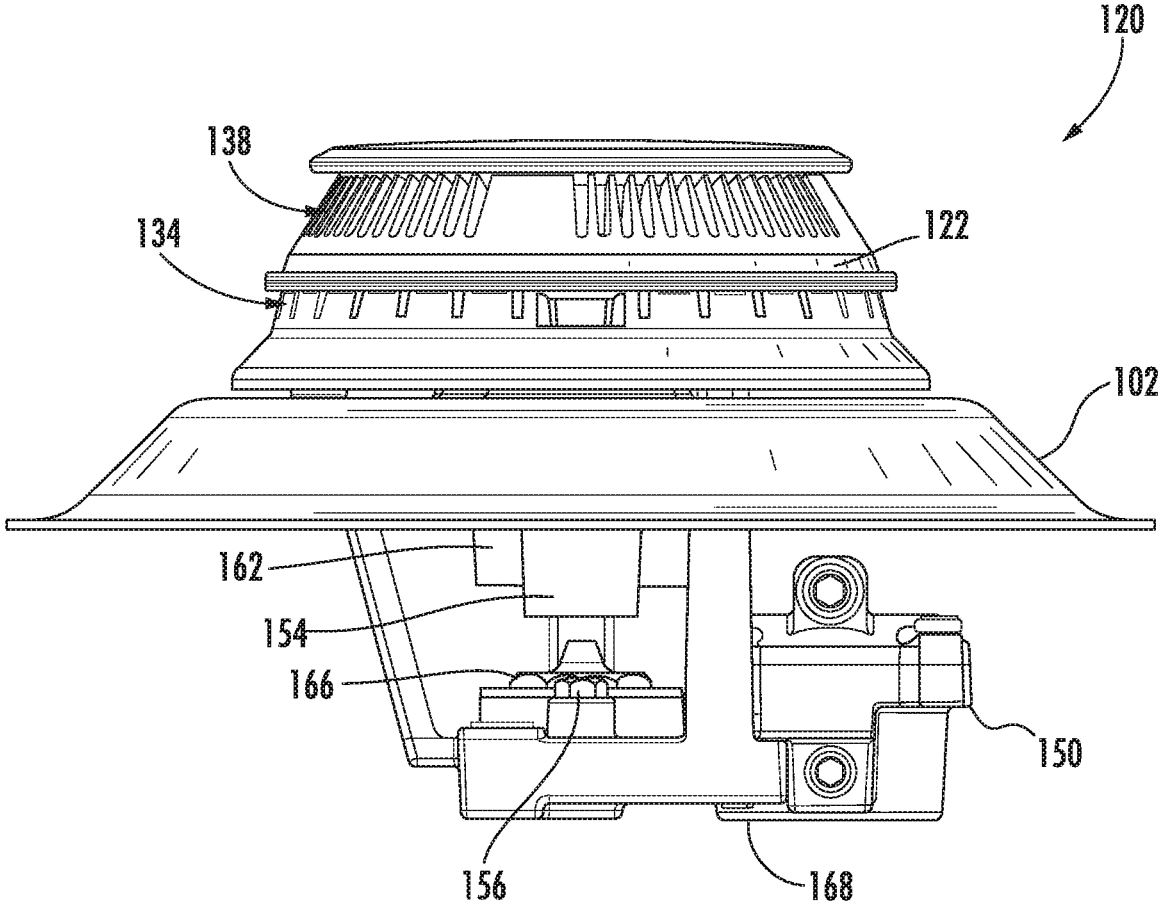
FIG. 2 is a side elevation view of a gas burner assembly that may be used with the exemplary cooktop appliance of FIG. 1 according to an exemplary embodiment of the present subject matter.
Figure 3:
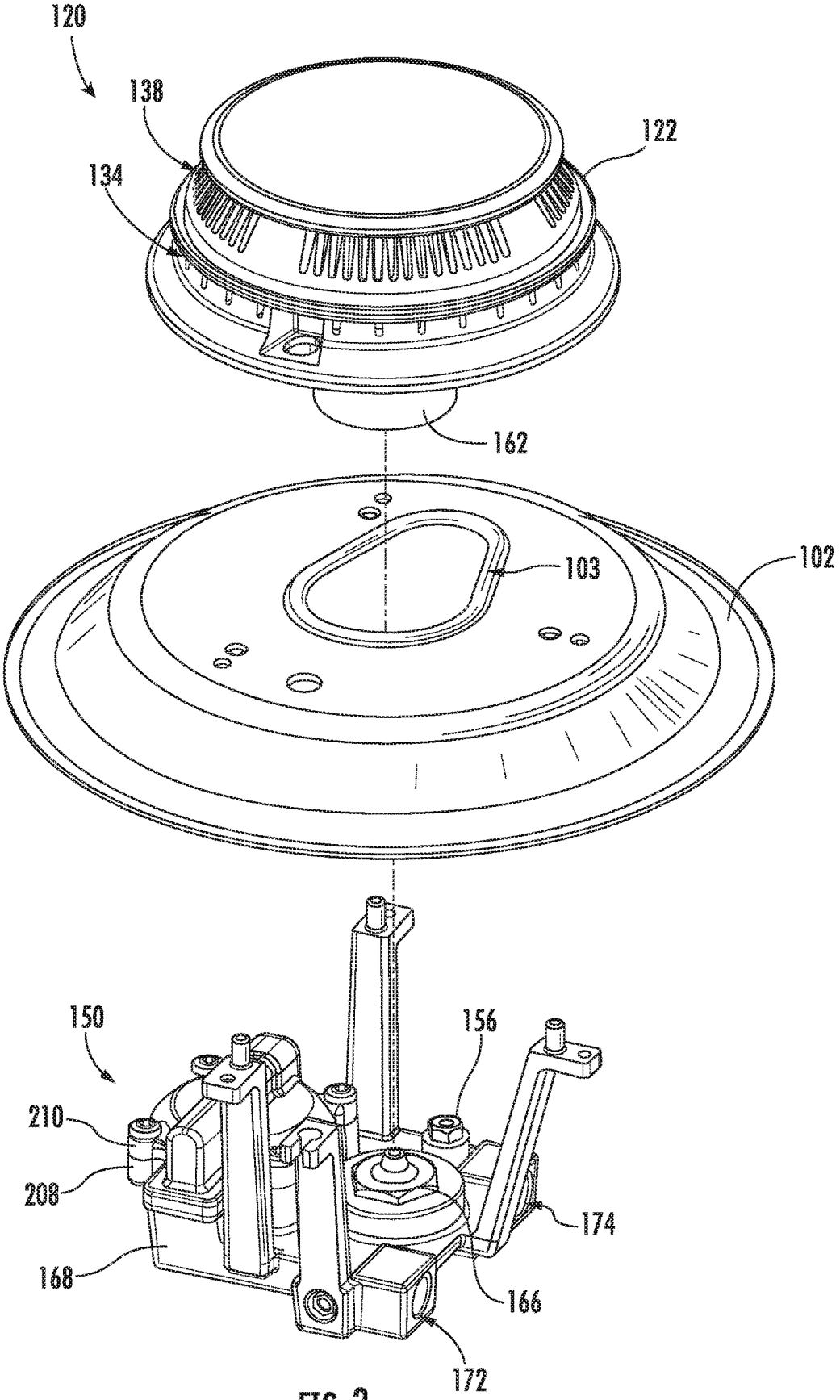
FIG. 3 is an exploded view of the example gas burner of assembly FIG. 2.
Figure 4:
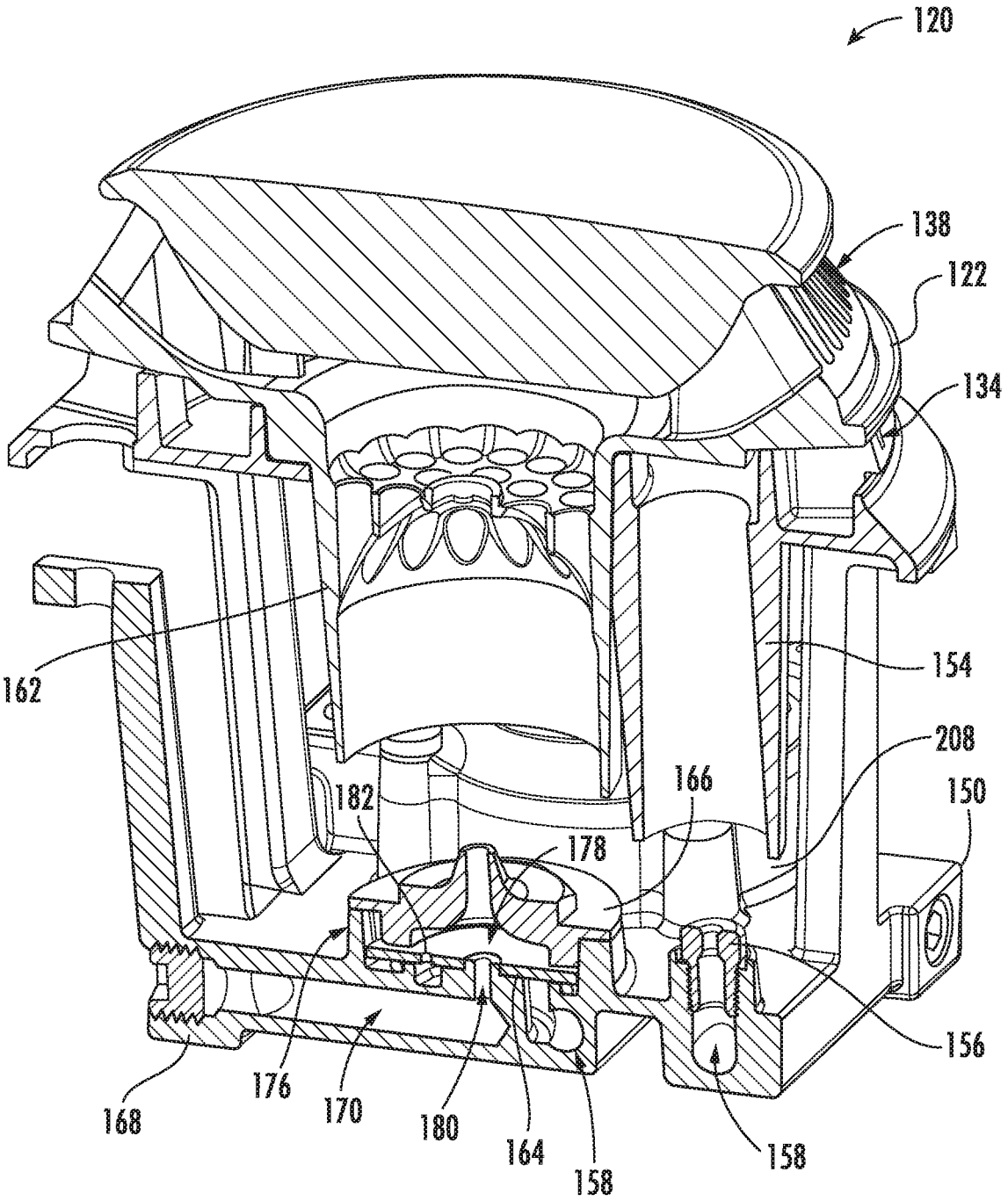
FIG. 4 is a section view of the example gas burner assembly of FIG. 2.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

The present disclosure relates generally to a gas burner for a cooktop appliance 100. Although cooktop appliance 100 is used below for the purpose of explaining the details of the present subject matter, it will be appreciated that the present subject matter may be used in or with any other suitable appliance in alternative example embodiments. For example, the gas burner described below may be used on other types of cooking appliances, such as single or double oven range appliances. Cooktop appliance 100 is used in the discussion below only for the purpose of explanation, and such use is not intended to limit the scope of the present disclosure to any particular style of appliance.

FIG. 1 illustrates an exemplary embodiment of a cooktop appliance 100 of the present disclosure. Cooktop appliance 100 may be, e.g., fitted integrally with a surface of a kitchen counter, may be configured as a slide-in cooktop unit, or may be a part of a free-standing range cooking appliance. Cooktop appliance 100 includes a top panel 102 that includes one or more heating sources, such as heating elements 104 for use in, e.g., heating or cooking. Top panel 102, as used herein, refers to any upper surface of cooktop appliance 100 on which utensils may be heated and therefore food cooked. In general, top panel 102 may be constructed of any suitably rigid and heat resistant material capable of supporting heating elements 104, cooking utensils, and/or other components of cooktop appliance 100. By way of example, top panel 102 may be constructed of enameled steel, stainless steel, glass, ceramics, and combinations thereof.

According to the illustrated embodiment, cooktop appliance 100 is generally referred to as a "gas cooktop," and heating elements 104 are gas burners. For example, one or more of the gas burners in cooktop appliance 100 may be a gas burner 120 described below. As illustrated, heating elements 104 are positioned on and/or within top panel 102 and have various sizes, as shown in FIG. 1, so as to provide for the receipt of cooking utensils (i.e., pots, pans, etc.) of various sizes and configurations and to provide different heat inputs for such cooking utensils.

In addition, cooktop appliance 100 may include one or more grates 106 configured to support a cooking utensil, such as a pot, pan, etc. In general, grates 106 include a plurality of elongated members 108, e.g., formed of cast metal, such as cast iron. The cooking utensil may be placed on the elongated members 108 of each grate 106 such that the cooking utensil rests on an upper surface of elongated members 108 during the cooking process. Heating elements 104 are positioned underneath the various grates 106 such that heating elements 104 provide thermal energy to cooking utensils above top panel 102 by combustion of fuel below the cooking utensils.

According to the illustrated example embodiment, a user interface panel or control panel 110 is located within convenient reach of a user of cooktop appliance 100. For this example embodiment, control panel 110 includes control knobs 112 that are each associated with one of heating elements 104. Control knobs 112 allow the user to activate each heating element 104 and regulate the amount of heat input each heating element 104 provides to a cooking utensil located thereon, as described in more detail below. Although cooktop appliance 100 is illustrated as including control knobs 112 for controlling heating elements 104, it will be understood that control knobs 112 and the configuration of cooktop appliance 100 shown in FIG. 1 is provided by way of example only. More specifically, control panel 110 may include various input components, such as one or more of a variety of touch-type controls, electrical, mechanical or electro-mechanical input devices including rotary dials, push buttons, and touch pads.

According to the illustrated embodiment, control knobs 112 are located within control panel 110 of cooktop appliance 100. However, it should be appreciated that this location is used only for the purpose of explanation, and that other locations and configurations of control panel 110 and control knobs 112 are possible and within the scope of the present subject matter. Indeed, according to alternative embodiments, control knobs 112 may instead be located directly on top panel 102 or elsewhere on cooktop appliance 100, e.g., on a backsplash, front bezel, or any other suitable surface of cooktop appliance 100. Control panel 110 may also be provided with one or more graphical display devices, such as a digital or analog display device designed to provide operational feedback to a user.

Turning now to FIGS. 2 through 8, a gas burner 120 according to an example embodiment of the present disclosure is described. Gas burner 120 may be used in cooktop appliance 100, e.g., as one of heating elements 104. Thus, gas burner 120 is described in greater detail below in the context of cooktop appliance 100. However, it will be understood that gas burner 120 may be used in or with any other suitable cooktop appliance in alternative example embodiments.

Gas burner 120 includes a burner body 122. Burner body 122 generally defines a first burner ring or stage (e.g., a primary burner 130) and a second burner ring or stage (e.g., a boost burner 132). More specifically, primary burner 130 generally includes a plurality of naturally aspirated or primary flame ports 134 and a primary fuel chamber 136 which are defined at least in part by burner body 122. Similarly, boost burner 132 generally includes a plurality of forced air or boost flame ports 138 and a boost fuel chamber 140 which are defined at least in part by burner body 122.

As illustrated, primary flame ports 134 and boost flame ports 138 may both be distributed in rings on burner body 122. In addition, primary flame ports 134 may be positioned concentric with boost flame ports 138. Further, primary flame ports 134 (and primary burner 130) may be positioned below boost flame ports 138 (and boost burner 132). Such positioning of primary burner 130 relative to boost burner 132 may improve combustion of gaseous fuel when gas burner assembly 120 is set to the boost position. For example, flames at primary burner 130 may assist with lighting gaseous fuel at boost burner 132 due to the position of primary burner 130 below boost burner 132.

With reference to FIGS. 2 through 8, gas burner 120 also includes an injet assembly 150. Injet assembly 150 may be positioned below top panel 102, e.g., below an opening 103 (FIG. 3) of top panel 102. Conversely, burner body 122 may be positioned on top panel 102, e.g., over opening 103 of top panel 102. Thus, burner body 122 may cover opening 103 of top panel 102 when burner body 122 is positioned on top panel 102. When burner body 122 is removed from top panel 102, injet assembly 150 below top panel 102 is accessible through opening 103. Thus, e.g., a fuel orifice(s) of gas burner 120 on injet assembly 150 may be accessed by removing burner body 122 from top panel 102, and an installer may reach through opening 103 (e.g., with a wrench or other suitable tool) to change out the fuel orifice(s) of gas burner 120.

Injet assembly 150 is configured for directing a flow of gaseous fuel to primary flame ports 134 of burner body 122. Thus, injet assembly 150 may be coupled to a gaseous fuel source 152, as described in more detail below with reference to FIG. 10. During operation of gas burner 120, gaseous fuel from gaseous fuel source 152 may flow from injet assembly 150 into a vertical Venturi mixing tube 154. In particular, injet assembly 150 includes a first gas orifice 156 that is in fluid communication with a gas passage 158. A jet of gaseous fuel from gaseous fuel source 152 may exit injet assembly 150 at first gas orifice 156 and flow towards vertical Venturi mixing tube 154. Between first gas orifice 156 and vertical Venturi mixing tube 154, the jet of gaseous fuel from first gas orifice 156 may entrain air into vertical Venturi mixing tube 154. Air and gaseous fuel may mix within vertical Venturi mixing tube 154 prior to flowing into primary fuel chamber 136 and through primary flame ports 134 where the mixture of air and gaseous fuel may be combusted.

Injet assembly 150 is also configured for directing a flow of air and gaseous fuel to boost flame ports 138 of burner body 122. Thus, as discussed in greater detail below, injet assembly 150 may be coupled to pressurized air source 160 in addition to gaseous fuel source 152. During boosted operation of gas burner 120, a mixed flow of gaseous fuel from gaseous fuel source 152 and air from pressurized air source 160 may flow from injet assembly 150, through an inlet tube 162, and into boost fuel chamber 140 prior to flowing to boost flame ports 138 where the mixture of gaseous fuel and air may be combusted at boost flame ports 138.

In addition to first gas orifice 156, injet assembly 150 also includes a second gas orifice 164, a mixed outlet nozzle 166, and an injet body 168. Injet body 168 defines an air passage 170 and gas passage 158. Air passage 170 may be in fluid communication with pressurized air source 160. For example, a pipe or conduit may extend between pressurized air source 160 and injet body 168, and pressurized air from pressurized air source 160 may flow into air passage 170 via such pipe or conduit. Gas passage 158 may be in fluid communication with gaseous fuel source 152. For example, a pipe or conduit may extend between gaseous fuel source 152 and injet body 168, and gaseous fuel from gaseous fuel source 152 may flow into gas passage 158 via such pipe or conduit. In certain example embodiments, injet body 168 defines a single inlet 172 for air passage 170 through which the pressurized air from pressurized air source 160 may flow into air passage 170, and injet body 168 defines a single inlet 174 for gas passage 158 through which the pressurized air from gaseous fuel source 152 may flow into gas passage 158.

First gas outlet orifice 156 is mounted to injet body 168, e.g., at a first outlet of gas passage 158. Thus, gaseous fuel from gaseous fuel source 152 may exit gas passage 158 through first gas outlet orifice 156, and gas passage 158 is configured for directing a flow of gaseous fuel through injet body 168 to first gas outlet orifice 156. On injet body 168, first gas outlet orifice 156 is oriented for directing a flow of gaseous fuel towards vertical Venturi mixing tube 154 and/or primary flame ports 134, as discussed above.

Second gas orifice 164 and injet body 168, e.g., collectively, form an eductor mixer 176 within a mixing chamber 178 of injet body 168. Eductor mixer 176 is configured for mixing pressurized air from air passage 170 with gaseous fuel from gas passage 158 in mixing chamber 178. In particular, an outlet 180 of air passage 170 is positioned at mixing chamber 178. A jet of pressurized air from pressurized air source 160 may flow from air passage 170 into mixing chamber 178 via outlet 180 of air passage 170. Second gas orifice 164 is positioned within injet body 168 between mixing chamber 178 and gas passage 158. Gaseous fuel from gaseous fuel source 152 may flow from gas passage 158 into mixing chamber 178 via second gas orifice 164. As an example, second gas orifice 164 may be a plate that defines a plurality of through holes 182, and the gaseous fuel in gas passage 158 may flow through holes 182 into mixing chamber 178.

The jet of pressurized air flowing into mixing chamber 178 via outlet 180 of air passage 170 may draw and entrain gaseous fuel flowing into mixing chamber 178 via second gas orifice 164. In addition, as the gaseous fuel is entrained into the air, a mixture of air and gaseous fuel is formed within mixing chamber 178. From mixing chamber 178, the mixture of air and gaseous fuel may flow from mixing chamber 178 via mixed outlet nozzle 166. In particular, mixed outlet nozzle 166 is mounted to injet body 168 at mixing chamber 178, and mixed outlet nozzle 166 is oriented on injet body 168 for directing the mixed flow of air and gaseous fuel from mixing chamber 178, through inlet tube 162, into boost fuel chamber 140, and/or towards boost flame ports 138, as discussed above.

Burner body 122 may be positioned over injet body 168, e.g., when burner body 122 is positioned on top panel 102. In addition, first gas orifice 156 may be oriented on injet body 168 such that first gas orifice 156 directs the flow of gaseous fuel upwardly towards vertical Venturi mixing tube 154 and primary flame ports 134. Similarly, mixed outlet nozzle 166 may be oriented on injet body 168 such that mixed outlet nozzle 166 directs the mixed flow of air and gaseous fuel upwardly towards inlet tube 162 and boost flame ports 138.

First and second gas orifices 156, 164 may be removeable from injet body 168. First and second gas orifices 156, 164 may also be positioned on injet body 168 directly below burner body 122, e.g., when burner body 122 is positioned on top panel 102. Thus, e.g., first and second gas orifices 156, 164 may be accessed by removing burner body 122 from top panel 102, and an installer may reach through opening 103 (e.g., with a wrench or other suitable tool) to change out first and second gas orifices 156, 164.

Injet assembly 150 also includes a pneumatically actuated gas valve 200. Pneumatically actuated gas valve 200 may be positioned within injet body 168, and pneumatically actuated gas valve 200 is adjustable between a closed configuration and an open configuration. In the closed configuration, pneumatically actuated gas valve 200 blocks the flow of gaseous fuel through gas passage 158 to second gas orifice 164, eductor mixer 176, and/or mixed outlet nozzle 166. Conversely, pneumatically actuated gas valve 200 permits the flow of gaseous fuel through gas passage 158 to second gas orifice 164/eductor mixer 176 in the open configuration. Pneumatically actuated gas valve 200 is configured to adjust from the closed configuration to the open configuration in response to the flow of air through air passage 170 to outlet 180 of air passage 170. Thus, e.g., pneumatically actuated gas valve 200 is in fluid communication with air passage 170 and opens in response to air passage 170 being pressurized by air from pressurized air source 160. As an example, pneumatically actuated gas valve 200 may be positioned on a branch of air passage 170 relative to outlet 180 of air passage 170.

It will be understood that first gas outlet orifice 156 may be in fluid communication with gas passage 158 in both the open and closed configurations of pneumatically actuated gas valve 200. Thus, first gas outlet orifice 156 may be positioned on gas passage 158 upstream of pneumatically actuated gas valve 200 relative to the flow of gas through gas passage 158. Thus, e.g., pneumatically actuated gas valve 200 may not regulate the flow of gas through second gas orifice 164 but not first gas outlet orifice 156.

Figure 5:
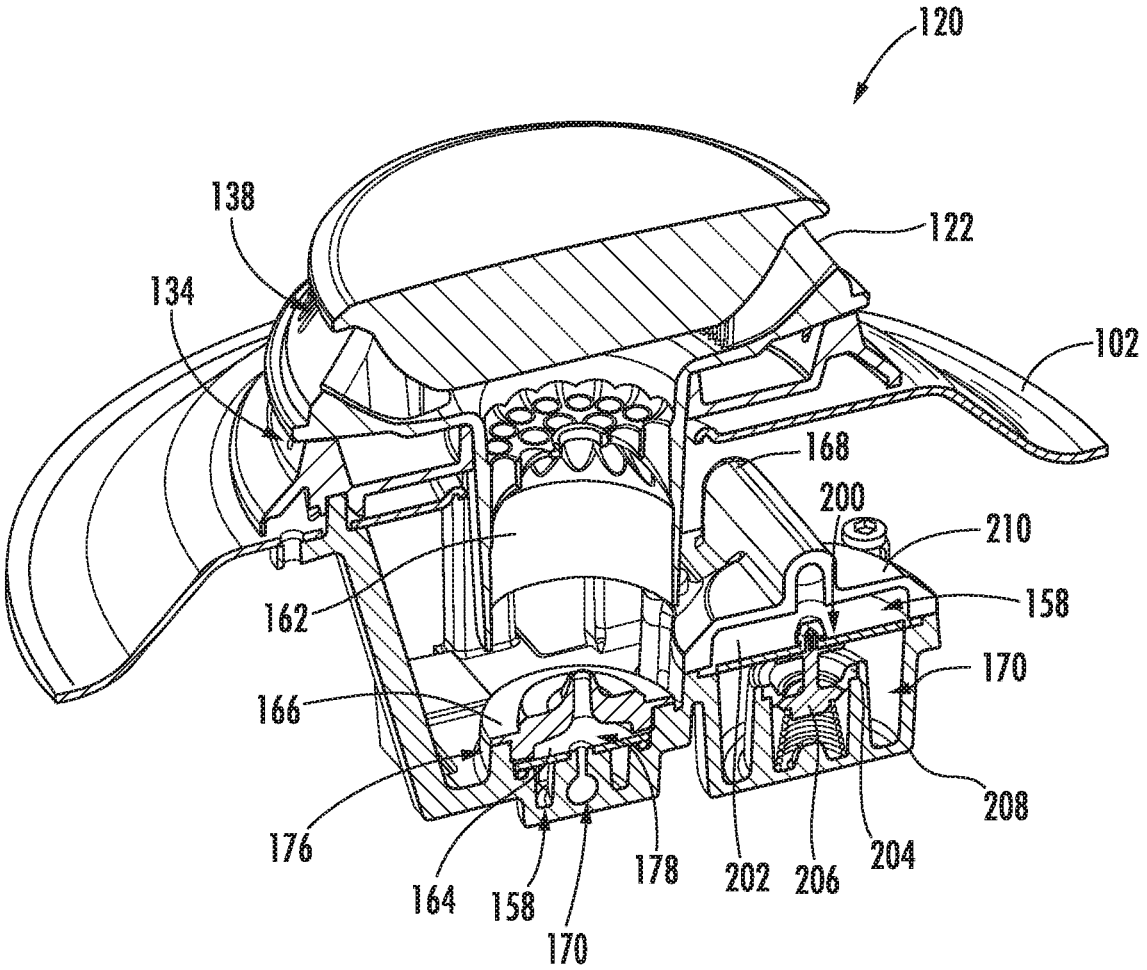
FIG. 5 is another section view of the example gas burner assembly of FIG. 2.
Figure 6:
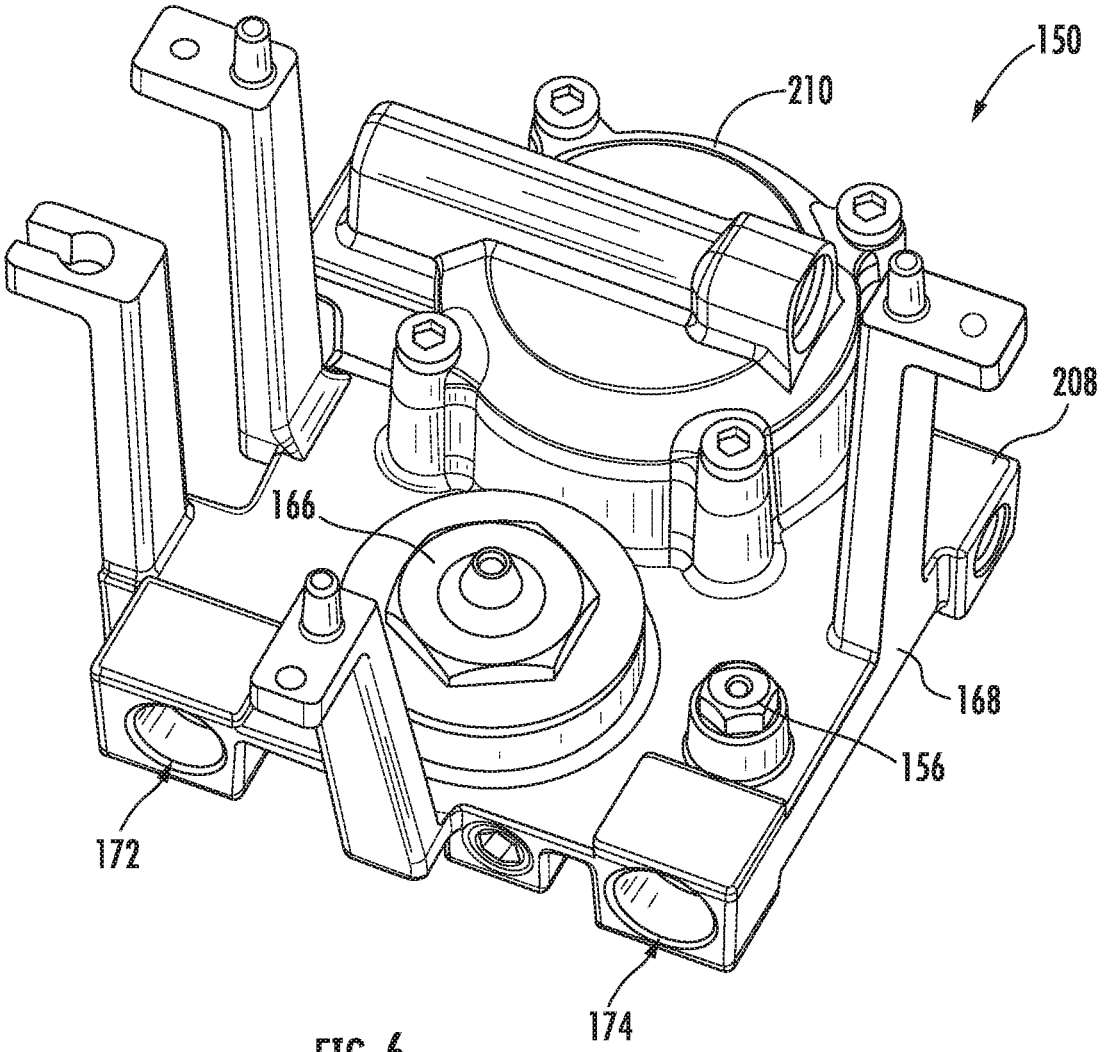
FIG. 6 is a perspective view of an injet of the example gas burner assembly of FIG. 2.
Figure 7:
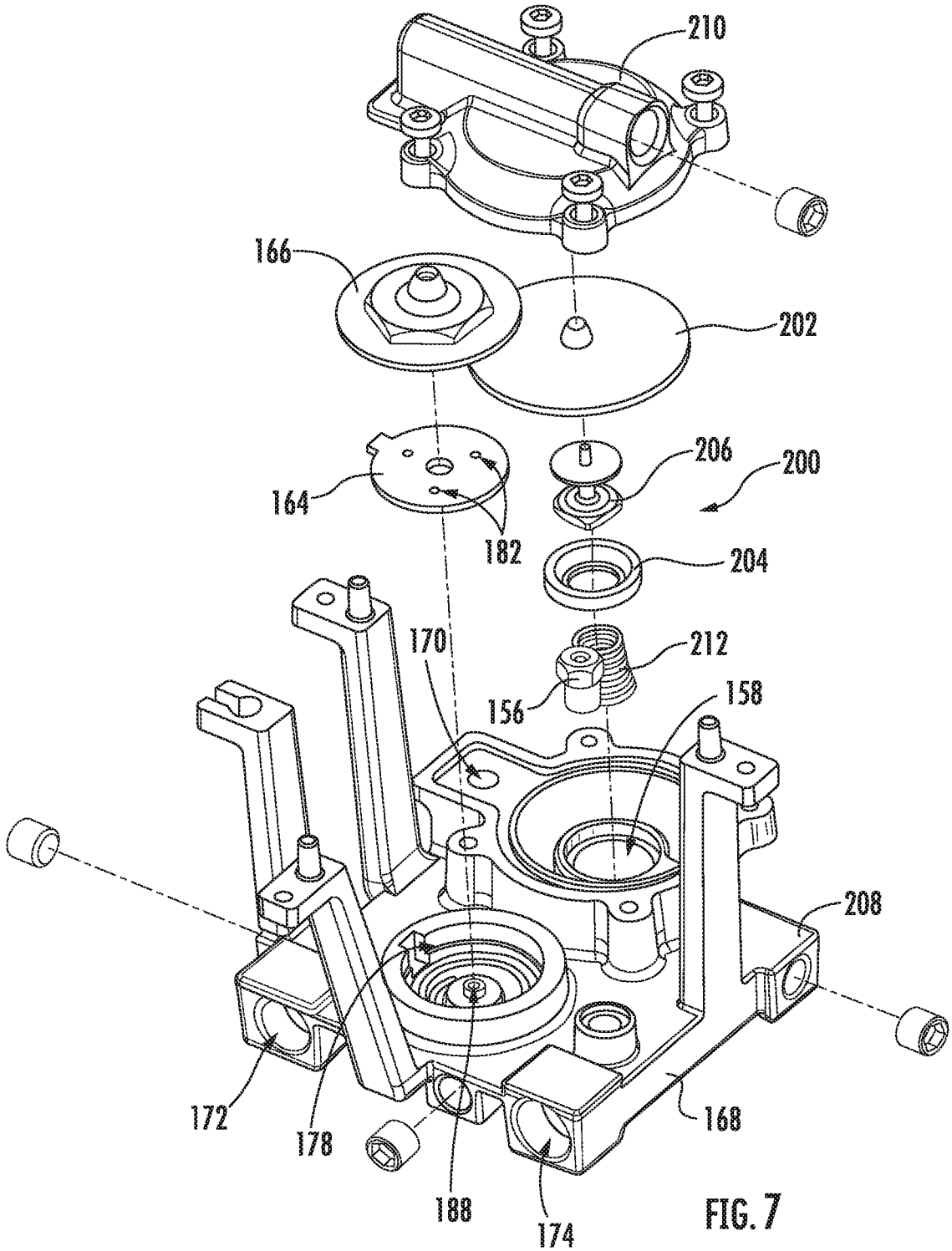
FIG. 7 is an exploded view of the injet of FIG. 7.
Figure 8:
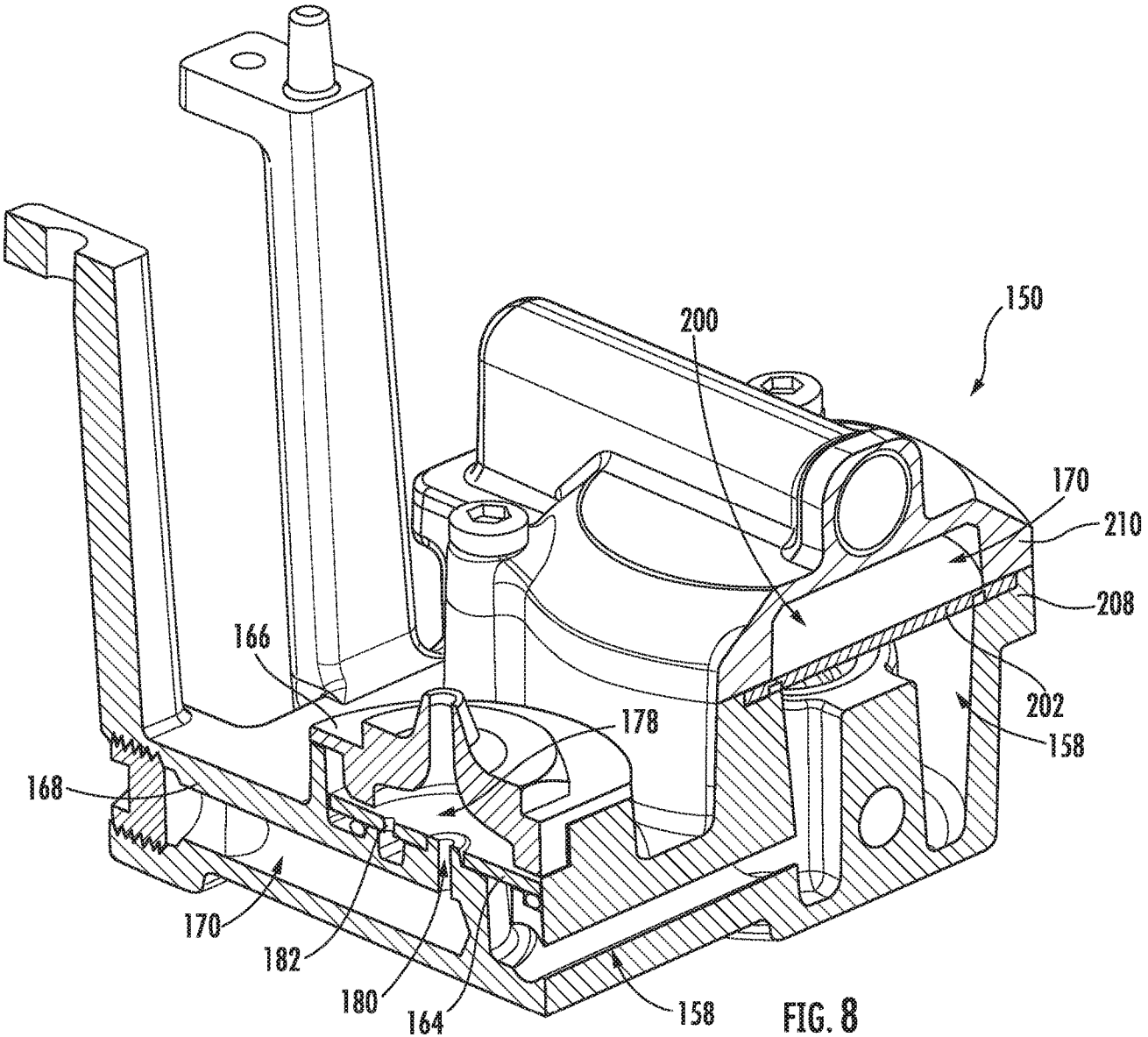
FIG. 8 is a section view of the injet of FIG. 7.

As shown in FIGS. 5 and 7, pneumatically actuated gas valve 200 includes a diaphragm 202, a seal 204, and a plug 206. Diaphragm 202 is positioned between air passage 170 and gas passage 158 within injet body 168. For example, diaphragm 202 may be circular and may be clamped between a first injet body half 208 and a second injet body half 210. In particular, first and second injet body halves 208, 210 may be fastened together with diaphragm 202 positioned between first and second injet body halves 208, 210.

Seal 204 is mounted to injet body 168 within gas passage 158. Plug 206 is mounted to diaphragm 202, e.g., such that plug 206 travels with diaphragm 202 when diaphragm 202 deforms. Plug 206 is positioned against seal 204 when pneumatically actuated gas valve 200 is closed. A spring 212 may be coupled to plug 206. Spring 212 may urge plug 206 towards seal 204. Thus, pneumatically actuated gas valve 200 may be normally closed.

When air passage 170 is pressurized by air from pressurized air source 160, diaphragm 202 may deform due to the pressure of air in air passage 170 increasing, and plug 206 may shift away from seal 204 as diaphragm 202 deforms. In such a manner, diaphragm 202, seal 204, and plug 206 may cooperate to open pneumatically actuated gas valve 200 in response to air passage 170 being pressurized by air from pressurized air source 160. Conversely, diaphragm 202 may return to an undeformed state when air passage 170 is no longer pressurized by air from pressurized air source 160, and plug 206 may shift against seal 204. In such a manner, diaphragm 202, seal 204 and plug 206 may cooperate to close pneumatically actuated gas valve 200 in response to air passage 170 no longer being pressurized by air from pressurized air source 160.

Operation of cooktop appliance 100 and gas burner assemblies 120 may be controlled by electromechanical switches or by a controller or processing device 220 (FIGS. 1 and 9) that is operatively coupled to control panel 110 for user manipulation, e.g., to control the operation of heating elements 104. In response to user manipulation of control panel 110 (e.g., via control knobs 112 and/or a touch screen interface), controller 220 operates the various components of cooktop appliance 100 to execute selected instructions, commands, or other features.

As described in more detail below with respect to FIG. 9, controller 220 may include a memory and microprocessor, such as a general or special purpose microprocessor operable to execute programming instructions or micro-control code associated with appliance operation. Alternatively, controller 220 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 110 and other components of cooktop appliance 100 may be in communication with controller 220 via one or more signal lines or shared communication busses.

Figure 9:
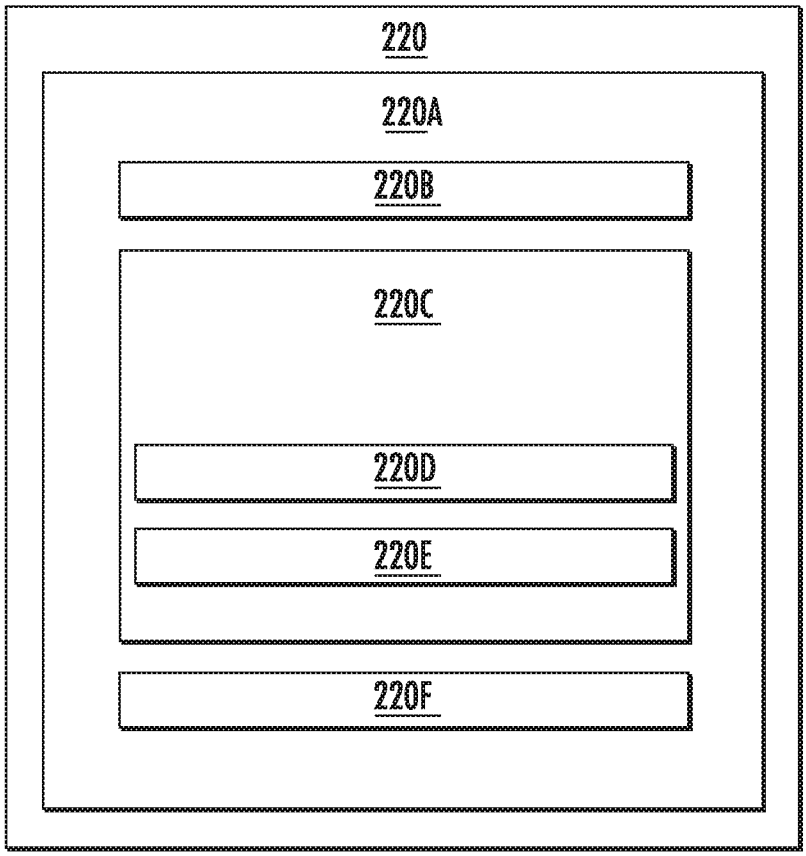
FIG. 9 depicts certain components of a controller according to example embodiments of the present subject matter.

FIG. 9 depicts certain components of controller 220 according to example embodiments of the present disclosure. Controller 220 can include one or more computing device(s) 220A which may be used to implement methods as described herein. Computing device(s) 220A can include one or more processor(s) 220B and one or more memory device(s) 220C. The one or more processor(s) 220B can include any suitable processing device, such as a microprocessor, microcontroller, integrated circuit, an application specific integrated circuit (ASIC), a digital signal processor (DSP), a field-programmable gate array (FPGA), logic device, one or more central processing units (CPUs), graphics processing units (GPUs) (e.g., dedicated to efficiently rendering images), processing units performing other specialized calculations, etc. The memory device(s) 220C can include one or more non-transitory computer-readable storage medium(s), such as RAM, ROM, EEPROM, EPROM, flash memory devices, magnetic disks, etc., and/or combinations thereof.

The memory device(s) 220C can include one or more computer-readable media and can store information accessible by the one or more processor(s) 220B, including instructions 220D that can be executed by the one or more processor(s) 220B. For instance, the memory device(s) 220C can store instructions 220D for running one or more software applications, displaying a user interface, receiving user input, processing user input, etc. In some implementations, the instructions 220D can be executed by the one or more processor(s) 220B to cause the one or more processor(s) 220B to perform operations, e.g., such as one or more portions of methods described herein. The instructions 220D can be software written in any suitable programming language or can be implemented in hardware. Additionally, and/or alternatively, the instructions 220D can be executed in logically and/or virtually separate threads on processor(s) 220B.

The one or more memory device(s) 220C can also store data 220E that can be retrieved, manipulated, created, or stored by the one or more processor(s) 220B. The data 220E can include, for instance, data to facilitate performance of methods described herein. The data 220E can be stored in one or more database(s). The one or more database(s) can be connected to controller 220 by a high bandwidth LAN or WAN, or can also be connected to controller through one or more networks (not shown). The one or more database(s) can be split up so that they are located in multiple locales. In some implementations, the data 220E can be received from another device.

The computing device(s) 220A can also include a communication module or interface 220F used to communicate with one or more other component(s) of controller 220 or cooktop appliance 100 over the network. The communication interface 220F can include any suitable components for interfacing with one or more network(s), including for example, transmitters, receivers, ports, controllers, antennas, or other suitable components.

Figure 10:
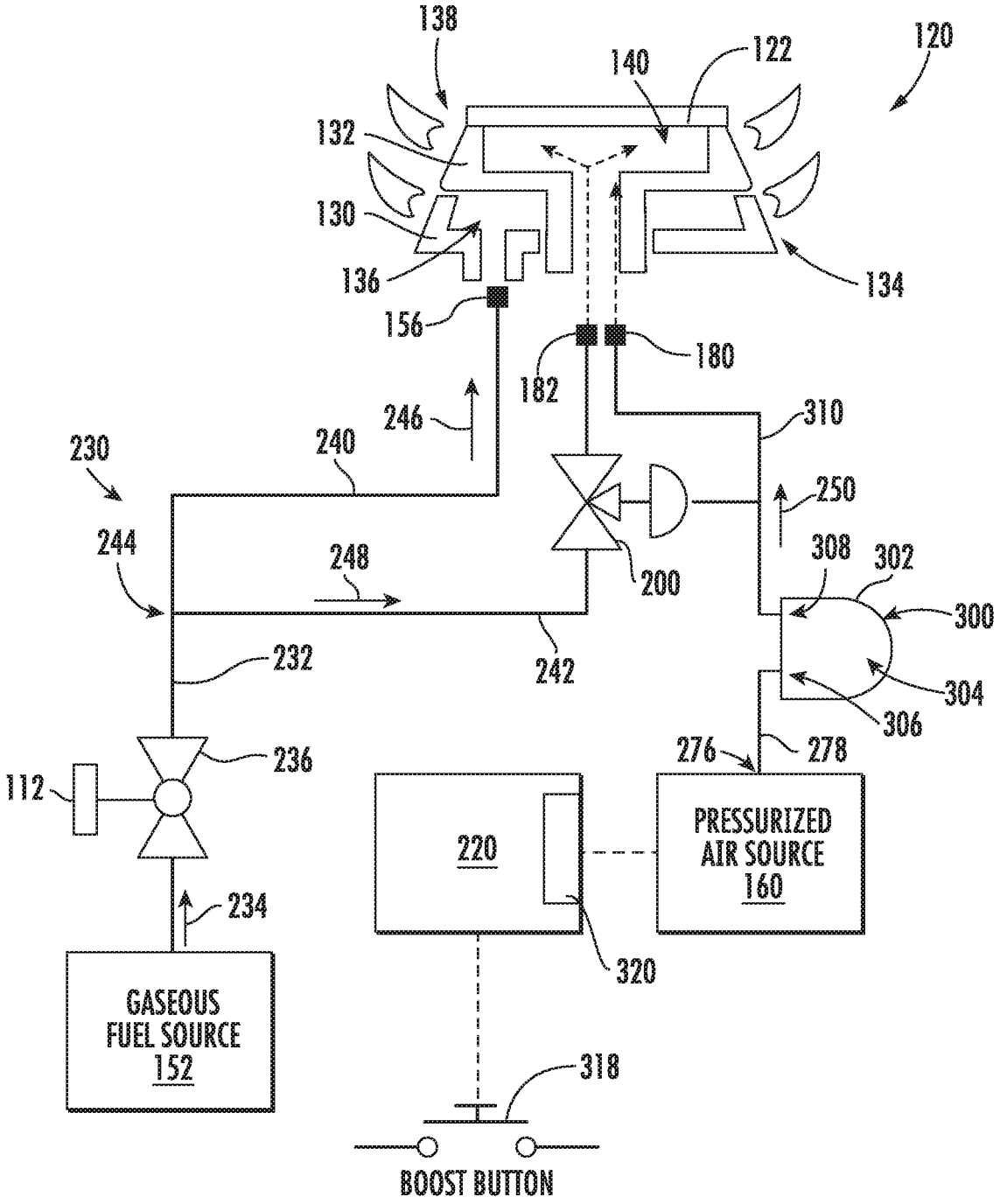
FIG. 10 is a schematic view of a gas burner assembly and a fuel supply system according to an example embodiment of the present subject matter.

Referring now to FIG. 10, a schematic view of gas burner assembly 120 and a fuel supply system 230 will be described. In general, fuel supply system 230 is configured for selectively supplying gaseous fuel such as propane or natural gas to primary burner 130 and boost burner 132 to regulate the amount of heat generated by the respective stages. In particular, fuel supply system 230 is configured for selectively supplying gaseous fuel to only primary burner 130 or to both primary burner 130 and boost burner 132 depending upon the desired output of gas burner assembly 120 selected by a user of gas burner assembly 120. Thus, primary burner 130 is separate or independent from boost burner 132, e.g., such that primary burner 130 is not in fluid communication with boost burner 132 within gas burner assembly 120. In such manner, gaseous fuel within gas burner assembly 120 does not flow between primary burner 130 and boost burner 132.

As shown in FIG. 10, fuel supply system 230 includes a supply line 232 that may be coupled to pressurized gaseous fuel source 152, such as a natural gas supply line or a propane tank. In this manner, a flow of supply fuel (indicated by arrow 234), such as gaseous fuel (e.g., natural gas or propane), is flowable from the pressurized gaseous fuel source 152 into supply line 232. Fuel supply system 230 further includes a control valve 236 operably coupled to supply line 232 for selectively directing a metered amount of fuel to primary burner 130 and boost burner 132.

More specifically, according to an exemplary embodiment, control knob 112 may be operably coupled to control valve 236 for regulating the flow of supply fuel 234. In this regard, a user may rotate control knob 112 to adjust the position of control valve 236 and the flow of supply fuel 234 through supply line 232. In particular, gas burner assembly 120 may have a respective heat output at each position of control knob 112 (and control valve 236), e.g., an off, high, medium, and low position. In addition, control knob 112 may be rotated to a lighting position to supply a suitable amount of gaseous fuel to primary burner 130 for ignition, which may be simultaneously achieved using, e.g., a spark electrode (not shown).

As best shown in FIG. 10, supply line 232 is split into a first branch (e.g., a primary fuel conduit 240) and a second branch (e.g., a boost fuel conduit 242) at a junction 244, e.g., via a plumbing tee, wye, or any other suitable splitting device. In general, primary fuel conduit 240 extends from junction 244 to an orifice for primary flame ports 134 (such as first gas orifice 156), which is positioned for directing a flow of primary fuel 246 into gas burner assembly 120, or more particularly into primary burner 130. Similarly, boost fuel conduit 242 extends from junction 244 to an orifice for boost flame ports 138 (such as second gas orifice 164 or holes 182 defined therein), which is positioned for directing a flow of boost fuel 248 into boost burner 132. Thus, supply line 232 is positioned upstream of primary and boost fuel conduits 240, 242 relative to a flow of gaseous fuel from fuel source 152 and primary and boost fuel conduits 240, 242 may separately supply the gaseous fuel from supply line 232 to primary burner 130 and boost burner 132.

Figure 11:
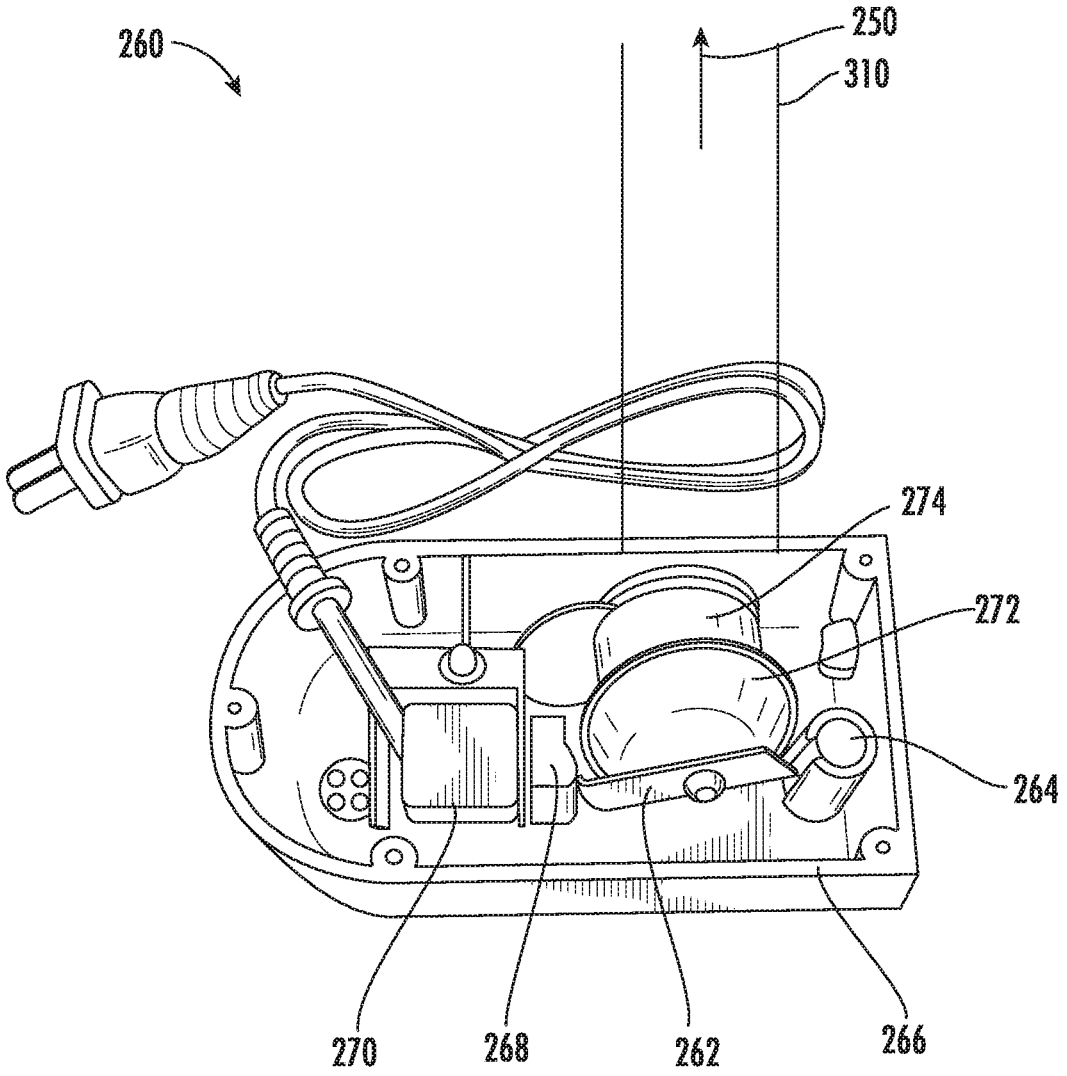
FIG. 11 is a perspective view of a pressurized air source that may be used with the exemplary gas burner assembly of FIG. 2 according to an exemplary embodiment of the present subject matter.

As explained above, boost burner 132 is a forced air or mechanically aspirated burner. For example, as illustrated in FIG. 10, fuel supply system 230 includes a pressurized air source 160 which is generally configured for providing a flow of combustion air 250 to boost burner 132 for mixing with boost flow of fuel 248. Referring now briefly to FIG. 11, an air pump 260 will be described according to an exemplary embodiment. According to exemplary embodiments, air pump 260 may be used as pressurized air source 160 described above.

Specifically, as illustrated, air pump 260 is a bellows-style air pump. As shown, air pump 260 includes a lever arm 262 that is pivotally mounted to a post 264 within a pump housing 266. Mounted to a distal end of lever arm 262 is a magnet 268 which may be driven back and forth by an alternating magnetic field generated by a magnetic field generator 270. In addition, a resilient diaphragm 272 is positioned over a pump body 274 adjacent lever arm 262. Pump body 274 may be fluidly coupled to an air pump outlet 276 defined by pump housing 266 which is configured for fluidly coupling to an air supply conduit, e.g., such as discharge conduit 278.

During operation of air pump 260, magnetic field generator 270 drives a magnet 268 and thus lever arm 262 back and forth to deflect or deform diaphragm 272, which is typically made from a resilient elastomer material, such as rubber. As diaphragm 272 is deflected, air within diaphragm 272 and pump body 274 is compressed and discharged through air pump outlet 276 and through discharge conduit 278. Notably, air pump 260 may be operated off AC line voltage having a frequency of 60 Hz. Thus, the flow of air 250 has a tendency to pulse at the same frequency.

Although an exemplary air pump 260 is described above, other types, positions, and configurations of pressurized air source 160 or air pump 260 are possible and within the scope of the present subject matter. For example, according to an exemplary embodiment, pressurized air source 160 may be a fan or an air pump, such as an axial or centrifugal fan, or any other device suitable for urging a flow of combustion air, such as an air compressor or a centralized compressed air system. Pressurized air source 160 may be configured for supplying the flow of combustion air 250 at any suitable gage pressure, such as a half to one psig.

Referring again specifically to FIG. 10, fuel supply system 230 may further include an accumulator 300 which is positioned between and fluidly couples pressurized air source 160 (e.g., air pump 260) to boost burner 132. Specifically, accumulator 300 may include an accumulator housing 302 that defines an accumulator volume 304 through which the flow of air 250 passes before entering boost fuel chamber 140.

Specifically, accumulator housing 302 defines in inlet 306 that is fluidly coupled to air pump outlet 276 through discharge conduit 278. In addition, accumulator housing 302 defines an outlet 308 that is fluidly coupled with an air supply conduit 310. As illustrated, air supply conduit 310 extends from accumulator 300 and provides fluid communication between accumulator volume 304 and boost fuel chamber 140, or more specifically, outlet 180 of air passage 172.

In addition, as described above, fuel supply system 230 includes pneumatically actuated gas valve 200, which is generally configured for regulating the flow of boost fuel 248 passing through boost fuel conduit 242 based at least in part on the flow of air 250 in air supply conduit 310. Therefore, air supply conduit 310 may also be fluidly coupled with pneumatically actuated gas valve 200. According to the exemplary embodiment, pneumatically actuated gas valve 200 is positioned downstream of accumulator 300 such that the pulses within flow of air 250 have been attenuated, thereby reducing the likelihood of chatter or operational issues with pneumatically actuated gas valve 200.

In general, accumulator 300 may be any device, mechanism, or system fluidly coupled to pressurized air source 160 or air pump 260 to smooth out surges or pulsations generated within the flow of air 250 during the pumping process. Accumulator 300 may be any suitable type of accumulator using any suitable method of operation, such as a weight loaded piston type accumulator, a diaphragm or bladder type accumulator, a spring type accumulator, or a hydro-pneumatic piston type accumulator. Although exemplary embodiments of accumulator 300 are described below, it should be appreciated that these are intended only for explaining aspects of the present subject matter and are not intended to be limiting in any manner.

Figure 12:
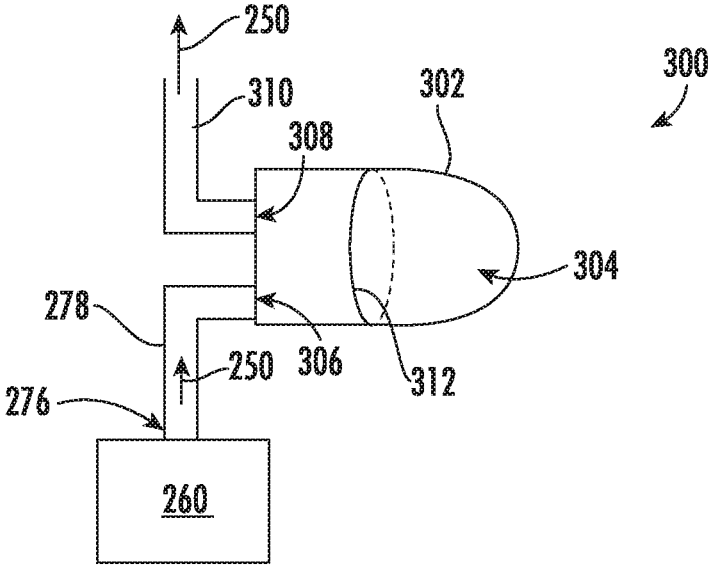
FIG. 12 is schematic view of an accumulator for use with the exemplary fuel supply system of FIG. 10 in accordance with one embodiment of the present disclosure.
Figure 13:
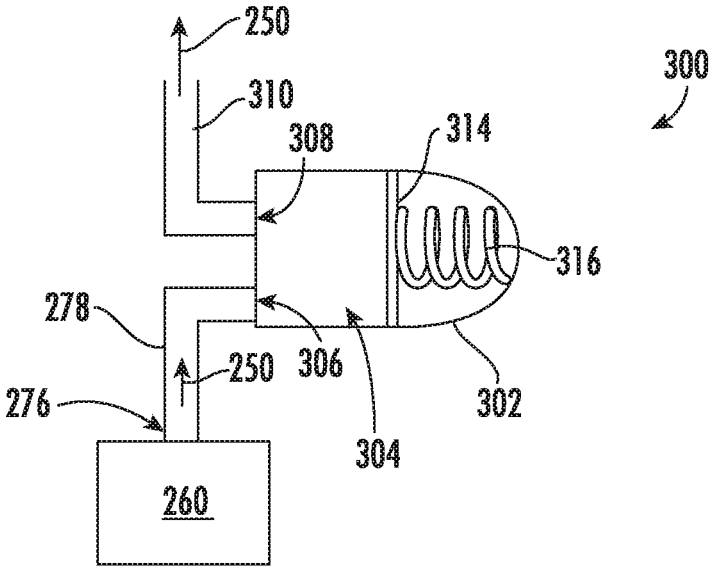
FIG. 13 is schematic view of an accumulator for use with the exemplary fuel supply system of FIG. 10 in accordance with another embodiment of the present disclosure.

Referring now to FIGS. 12 and 13, accumulators 300 will be described according to exemplary embodiments of the present subject matter. Due to the similarity of construction, similar reference numerals will be used to refer to similar features in each accumulator 300. It should be appreciated that modifications and variations to accumulator 300 may be made while remaining within the scope of the present subject matter.

As shown, inlet 306 and outlet 308 may be positioned on opposite ends of accumulator housing 302 such that the flow of air 250 must pass through the entirety of accumulator volume 304. According to an exemplary embodiment, accumulator volume 304 may be a simple open container for cushioning pressure variations within the pulsing the flow of air 250 received through inlet 306. The open volume permits the flow of air 250 to expand and interact with previously pumped air contained within accumulator volume 304. The flow of air 250 exiting outlet 308 is thus a more uniform and constant flow of air.

According to an exemplary embodiment, accumulator volume 304 may be at least 100 times greater than a pump stroke volume. In this regard, the pump stroke volume is the volume of air displaced with each pump stroke, e.g., movement of lever arm 262. For example, if air pump 260 is discharging 10 Liters per minute of air, this is equivalent to 0.0028 L per second. Thus, for example, accumulator volume 304 may be 100 times this flow rate, or 0.28 L. Alternatively, accumulator volume 304 could be 0.5 Liters, 1 Liter, or any other suitable volume.

In addition, accumulator 300 may include a variety of features for facilitating the damping process within accumulator volume 304. For example, referring specifically to FIG. 12, at least one diaphragm 312 may be positioned within accumulator housing 302 for providing a damping effect to the incoming flow of air 250. Specifically, diaphragm 312 may be resilient partition within accumulator volume 304 that may flex under the force of the flow of air 250. According to alternative embodiments, diaphragm 312 may instead be in the form of a bladder inflated with a fluid for deflecting or absorbing pulsations within the flow of air 250.

Referring now to FIG. 13, the accumulator 300 may also include a spring-loaded baffle positioned within accumulator volume 304. Specifically, the spring-loaded baffle may include a rigid baffle plate 314 that extends through accumulator volume 304 and a spring 316 that couples rigid baffle plate 314 to accumulator housing 302. According to exemplary embodiments, spring 316 may be a very weak mechanical spring that permits pulsations in the flow of air 250 to move rigid baffle plate 314 and facilitate operation of accumulator 300. Other variations and modifications to accumulator 300 may be made while remaining within the scope of the present subject matter.

Referring again to FIG. 10, a boost button 318 may be operably coupled to pressurized air source 160 through controller 220. In this regard, boost button 318 may be a momentary push button, a toggle switch, or any other suitable button or switch that is operably coupled with controller 220 for providing an indication to gas burner assembly 120 and pressurized air source 160 to enter boost mode. Thus, when boost burner button 318 is pressed, controller 220 may operate pressurized air source 160 to start boost mode operation. As an example, boost flame ports 138 may be activated by pressing a boost burner button 318 on control panel 110. In response to a user actuating boost burner button 318, pressurized air source 160 may be activated, e.g., with a timer control or with controller 220.

Specifically, controller 220 may include a power supply 320 that is operably coupled to air pump 260 for regulating its operation. For example, controller 220 may operate power supply 320 to drive air pump 260 in a manner that compensates for temperature response characteristics of air pump 260, or otherwise drives air pump 260 to provide the flow of air 250 at the desired flow rate. As used herein, "temperature response characteristics" are intended to refer to the operating or performance characteristics of air pump 260 which are affected by temperature changes of air pump 260 or the surrounding environment. More specifically, according to an exemplary embodiment, temperature response characteristics are intended to represent data (empirical or theoretical) or information regarding the performance of diaphragm 272 as it heats up during operation or from rising ambient temperatures.

According to exemplary embodiments, power supply 320 may regulate operation of air pump 260 by varying an input voltage or power. Alternatively, the power level of air pump 260 may be adjusted by manipulating a pump control signal. In this regard, for example, power supply 320 may be a dedicated inverter power supply and the pump control signal may be any suitable digital control signal, such as a pulse width modulated signal having a duty cycle that is roughly proportional to the power level of air pump 260. In this regard, for example, a fifty percent duty cycle may drive air pump 260 at fifty percent of its rated speed, an eighty percent duty cycle may drive air pump 260 at eighty percent of its rated speed, etc. It should be appreciated that other means for controlling the power level and speed of air pump 260 are possible and within the scope of the present subject matter.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A gas burner assembly for a cooktop appliance, the gas burner assembly comprising: a boost burner comprising a plurality of boost flame ports located above a plurality of primary flame ports in fluid communication with a boost fuel chamber for receiving a flow of boost fuel; an air pump actuated by a boost mode actuator for selectively urging a flow of air into the boost fuel chamber therein initiating a boost mode operation; and a pneumatic accumulator positioned between and fluidly coupling the air pump to the boost burner, the flow of air passing through the pneumatic accumulator before entering the boost fuel chamber activating the boost flame ports.

2. The gas burner assembly of claim 1, wherein the pneumatic accumulator comprises:

an inlet fluidly coupled to an air pump outlet;

an outlet fluidly coupled to an air supply conduit; and an accumulator housing defining an accumulator volume.

3. The gas burner assembly of claim 2, wherein the inlet and the outlet of the pneumatic accumulator are positioned on opposite ends of the accumulator housing.

4. The gas burner assembly of claim 2, wherein the air pump has a pump stroke volume, and wherein the accumulator volume is at least 100 times greater than the pump stroke volume.

5. The gas burner assembly of claim 1, wherein the pneumatic accumulator comprises:

at least one diaphragm positioned within the accumulator housing.

6. The gas burner assembly of claim 1, wherein the pneumatic accumulator comprises:

at least one spring-loaded baffle positioned within the accumulator housing.

7. The gas burner assembly of claim 1, further comprising:

a boost valve for regulating the flow of boost fuel to the boost fuel chamber, wherein the boost valve is configured for closing when the air pump is stopped.

8. The gas burner assembly of claim 7, wherein the boost valve is a pneumatically controlled valve.

9. The gas burner assembly of claim 8, wherein the boost valve is positioned downstream of the pneumatic accumulator and is fluidly coupled to the outlet.

10. The gas burner assembly of claim 1, wherein the air pump is a bellows pump.

11. The gas burner assembly of claim 1, further comprising:

a primary burner comprising a plurality of primary flame ports in fluid communication with a primary fuel chamber for receiving a flow of primary fuel.

12. An air pump assembly for a gas burner, the gas burner comprising a boost burner comprising a plurality of boost flame ports located above a plurality of primary flame ports in fluid communication with a boost fuel chamber for receiving a flow of boost fuel, the air pump assembly comprising: an air pump actuated by a boost mode actuator for selectively urging a flow of air through an air pump outlet and into the boost fuel chamber therein initiating a boost mode operation; and a pneumatic accumulator positioned downstream of the air pump outlet between the air pump and the boost burner, the flow of air passing through the pneumatic accumulator before entering the boost fuel chamber activating the boost flame ports.

13. The air pump assembly of claim 12, wherein the pneumatic accumulator comprises:

an inlet fluidly coupled to the air pump outlet;

an outlet fluidly coupled to an air supply conduit; and an accumulator housing defining an accumulator volume.

14. The air pump assembly of claim 13, wherein the inlet and the outlet of the pneumatic accumulator are positioned on opposite ends of the accumulator housing.

15. The air pump assembly of claim 13, wherein the air pump has a pump stroke volume, and wherein the accumulator volume is at least 100 times greater than the pump stroke volume.

16. The air pump assembly of claim 12, wherein the pneumatic accumulator comprises:

at least one diaphragm positioned within the accumulator housing.

17. The air pump assembly of claim 12, wherein the pneumatic accumulator comprises:

at least one spring loaded baffle positioned within the accumulator housing.

18. The air pump assembly of claim 12, wherein the gas burner further comprises:

a boost valve for regulating the flow of boost fuel to the boost fuel chamber, wherein the boost valve is pneumatically controlled and configured for closing when the air pump is stopped.

19. The air pump assembly of claim 18, wherein the boost valve is positioned downstream of the pneumatic accumulator.

20. The air pump assembly of claim 12, wherein the air pump is a bellows pump.

* * * * *